United States Patent [19]

Woertz

[11] Patent Number: 4,708,417

[45] Date of Patent: Nov. 24, 1987

[54] THREADLESS ELECTRIC TERMINAL

[75] Inventor: Hans Woertz, Basel, Switzerland

[73] Assignee: Oskar Woertz, Inhaber Hans Woertz, Muttenz, Switzerland

[21] Appl. No.: 911,158

[22] Filed: Sep. 24, 1986

[30] Foreign Application Priority Data

Oct. 9, 1985 [CH] Switzerland ..... 4348/85

[51] Int. Cl.[4] ..... H01R 9/00

[52] U.S. Cl. ..... 439/828

[58] Field of Search ..... 339/95 D, 260

[56] References Cited

U.S. PATENT DOCUMENTS

| | | | |
|---|---|---|---|
| 957,485 | 5/1910 | Beliveau | 339/260 |
| 985,821 | 3/1911 | Manson | 339/260 |
| 1,005,283 | 10/1911 | Neher | 339/260 |
| 1,724,729 | 8/1929 | Ruttenberg et al. | 339/260 |

*Primary Examiner*—Joseph H. McGlynn

*Attorney, Agent, or Firm*—Watson, Cole, Grindle & Watson

[57] ABSTRACT

A threadless electric connector includes a V-shaped plate spring having wing sections joined together to form a vertex at one end and overlapping arms at opposite ends having openings therein spaced from terminal ends of the arms such that an end portion of one of the arms at least partially blocks the opening in the other arm in an initial condition of the spring. One of the wing sections is attached to a support and electric contact element having a flange lying parallel to the arm of the one wing section and containing an opening. In operation, the wing sections are resiliently movable relatively toward one another for aligning all three openings for the reception of an elongated electric conductor which is clamped in place upon release of the pressure applied.

1 Claim, 11 Drawing Figures

THREADLESS ELECTRIC TERMINAL

BACKGROUND OF THE INVENTION

This invention relates generally to a threadless electric terminal.

SUMMARY OF THE INVENTION

It is an object of the present invention to provide a threadless electric terminal of simple construction requiring relatively little space and capable of being produced at low cost.

The terminal according to the invention is in the form a V-shaped plate of spring material acting as a V-spring, the plate having a pair of angularly spaced wing sections joined together to form a vertex at one end, the opposite ends of the wing sections having overlapping arms with openings therein spaced from terminal ends of the arms such that a portion of one of the arms at least partially blocks the opening in the other arm in an initial condition of the spring. The wing sections are resiliently movable toward one another from the initial condition into a spring loaded condition in response to an external force applied to at least one of the wings sections for aligning the openings with one another for the reception of an elongated electric conductor. During the spring loaded condition the wind sections are resiliently urged away from one another upon release of the external force for thereby clamping the conductor to the V-spring as opposing edges of the openings resiliently engage the conductor.

The wing sections may be flat, the vertex rounded and the arms arcuate. And, the wing sections may form an internal angle of from 110° to 140° in the initial condition, preferably 130°.

A first of the wing sections is attached to an electric current conducting support and contact element which has a flange lying parallel to the arm of this first wing section, the flange having an opening which at least partially aligns with the opening in the arm of the first wing section, such that the arm of the second of the wing sections resiliently urges the conductor into contact engagement with the flange in the spring loaded condition.

The flange of the contact element defines a space with the arm of the first wing section such that the overlying arm of the second section is movable in such space in the spring loaded condition.

The flange of the contact element may have a lug extending through the openings in the arms in the initial condition, such that the conductor is resiliently urged into contact engagement with the lug in the spring loaded condition.

Two of such plate springs may be attached to the contact element for connecting another elongated electric conductor to the contact element.

Other objects, advantages and novel features of the invention will become more apparent from the following detailed description of the invention when taken in conjunction with the accompanying drawings.

DETAILED DESCRIPTION OF THE INVENTION

Figure 1:
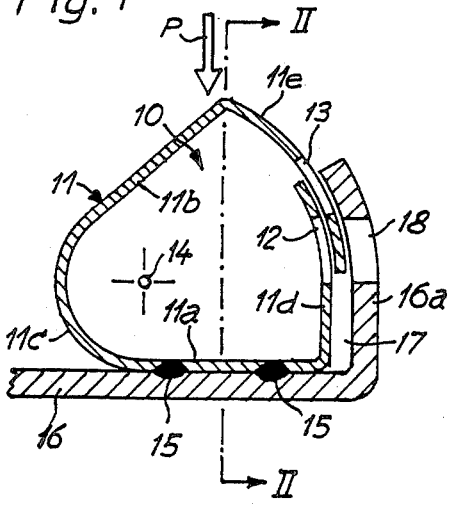
FIG. 1 is a fragmentary cross-sectional view taken substantially along the line I—I of FIG. 3, showing a first embodiment of the terminal according to the invention.
Figure 2:
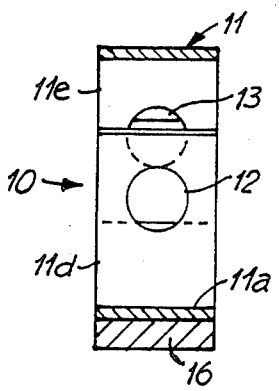
FIG. 2 is a cross-sectional view taken substantially along the line II—II of FIG. 1.
Figure 3:
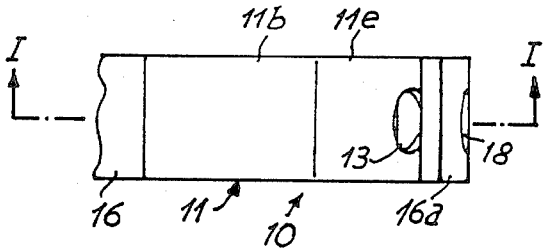
FIG. 3 is a plan view of FIG. 1.

Turning now to the drawings wherein like reference characters refer to like and corresponding parts throughout the several views, a threadless electric terminal 10 according to one embodiment of the invention is shown in FIGS. 1 to 4 as comprising a substantially V-shaped plate 11 of spring material forming a V-spring. The plate has a pair of angularly spaced wing sections 11*a* and 11*b*, each substantially flat and joined together to form a rounded vertex section 11*c* at one end. Overlapping arms 11*d* and 11*e* are provided at the opposite ends of wing sections 11*a* and 11*b*. These arms have through openings 12 and 13 therein spaced from the terminal ends of the respective arms such that an end portion of one of the arms 11*d*, 11*e* blocks opening 13,12 of the other of the arms in an initial condition of the spring shown in FIG. 1 to 3. In this initial or relaxed condition, wing sections 11*a* and 11*b* form an internal angle of from 110° to 140°, preferably 130°. Arms 11*d* and 11*e* may be arcuate having an axis of curvature 14 which coincides with the axis of curvature of rounded vortex section 11*c*. And, plate spring 11 is of electric current conduction material, for example non-corosive steel or spring bronze.

Figure 4:
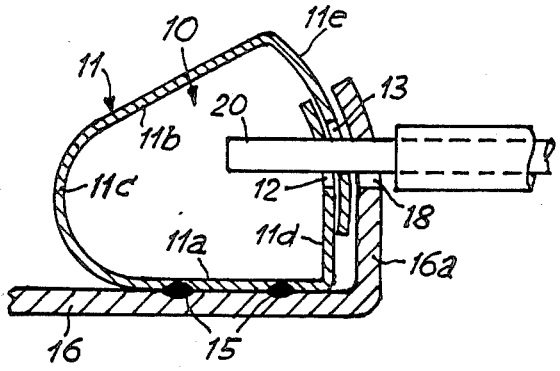
FIG. 4 is a view similar to FIG. 1 showing a connected elongated electric conductor.

The wing sections are resiliently movable relatively toward one another into the spring loaded condition of FIG. 4 in response to an external force P applied to one of the wing sections such as 11*b* so as to thereby align openings 12 and 13 with one another for the reception of an elongated electric conductor 20. In this spring loaded condition the wing sections are resiliently urged away from one another upon release of such external force so as to thereby clamp the connector to the V-spring as opposing edges of openings 12 and 13 resiliently engage the conductor, as clearly shown in FIG. 4.

One of the wing sections, such as 11*a*, is attached as by welding 15 to an electric current conducting support and contact element 16, as shown in FIGS. 1 to 4. This contact element has a flange 16*a* lying external and parallel to arm 11*d*. Flange 16*a* defines a space 17 with arm 11*d* into which space arm 11*e* extends in the conditions of FIG. 1 and 4.

Flange 16*a* has a through opening 18 therein which at least partially aligns with opening 12 such that conductor 20 may extend through openings 12, 13 and 18 when they are aligned in the spring loaded condition. Thus, arm 11*a* resiliently urges conductor 20 into contact engagement with flange 16*a* at opening 18 thereof in the spring loaded condition of FIG. 4.

It therefore can be seen that, in order to connect conductor 20 to the support and contact element 16, an external force is applied to spring 11 in the direction of arrow P in FIG. 1 such that wing section 11*b* is urged under the influence of the spring action of the V-spring toward wing secton 11*a* which is attached to element 16 and is thus stationary. Movement of wing section 11*b* continues until opening 13 is shifted into alignment with openings 12 and 18. Conductor 20 to be connected is then extended through aligned openings 12, 13, 18 after which the pressure exerted against wing section 11*b* is withdrawn. Under the influence of its spring resiliency, the plate spring tends to return to its initial (relaxed) condition as wing section 11*b* is resiliently urged away from wing section 11*a*. Thus, arm 11*e* resiliently urges conductor 20 into contact engagement with the upper edge of opening 18 and with the upper edge of opening 12, as shown in FIG. 4. Conductor 20 is therefore securely connected in place by the three edges of openings 12, 13 and 18, such that it cannot be removed from the terminal. Since flange 16*a* is stronger and more rigid than arms 11*d*, 11*e*, it is quite effective in preventing the arms from deforming if pulling forces are exerted on conductor 20.

Several electric conductors 20 of small diameter can be connected to the same terminal in the manner aforedescribed so as to make electric contact with the support and contact element 16. For this purpose, element 16 and plate spring 11 may simply be of greater width compared to that shown in FIG. 2 to accommodate the provision of another set of openings 12, 13 in plate 11 and another corresponding opening 18 in element 16 in the same manner and adjacent such openings shown in FIG. 2.

Conductor 20, or several connected conductors, can be disconnected by merely again applying an external force to plate spring 11 in the direction of arrow P of FIG. 1, such that the clamping pressure on the conductor(s) is relieved so that nothing now impedes the conductor or conductors from being pulled out.

The aforedescribed terminal 10 is suitable for example as a connecting terminal on electrical equipment.

Figure 5:
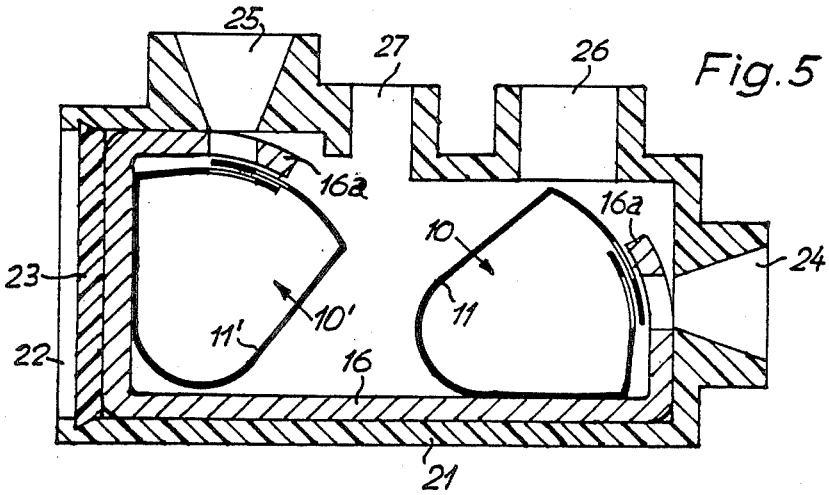
FIG. 5 is a longitudinal sectional view taken substantially along the line V—V of FIG. 6 showing another embodiment of a conductor connector with threadless terminals of the FIG. 1 type.

FIG. 5 illustrates an arrangement in which terminals 10 and 10' as aforedescribed can be assembled with a common support and contact element 16 which has an additional flange 16*a* in addition to flange 16*a* described in FIGS. 1 to 4. This additional flange 16*a* is a component of terminal 10' having a plate spring 11'. Whereas terminal 10 is arranged for horizontal extension of the conductor to be connected, similarly as in FIGS. 1 to 4, terminal 10' of FIG. 5 lies at a 90° angle to terminal 10 so that the conductor or conductors to be connected are fed to it from the top in a vertical direction. Other than the differences in spatial layout, both terminals 10 and 10' are of identical structure and function the same as described with reference to FIGS. 1 to 4.

The terminal pair 10, 10' of FIG. 5 is installed in a housing 21 of insulating material having an opening 22 through which the terminals are inserted. The opening may then be sealed by a cover 23 which is snap fitted or otherwise pressed in place.

Housing 21 has a funnel-shaped passage 24 for horizontal feed of a conductor or conductors into terminal 10, and has another funnel-shaped passage 25 for vertical feed of a conductor or conductors into terminal 10'. Housing 21 has a further passage 26 through which an external force may be applied to the plate spring of terminal 10 for resiliently moving the wing sections relatively toward one another into the spring loaded condition as described in FIGS. 1 to 4. Such a force may be applied via a pushing tool (not shown) as for example a screw driver.

Housing 21 has a further passage 27 through which the wing sections of the plate spring of terminal 10' may be resiliently moved relative to one another upon the application of a somewhat horizontally directed force via a rod-shaped tool such as a screw driver. Thus, the FIG. 5 assembly facilitates the connection of two or more electric conductors to one another in that conductors 20 are clamped to both flanges 16*a* of contact element 16.

Figure 6:
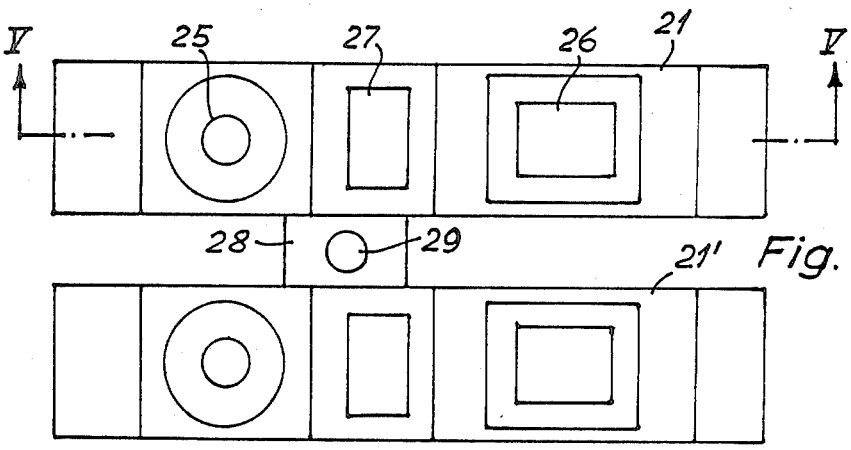
FIG. 6 is a plan view of the conductor connector of FIG. 5.
Figure 7:
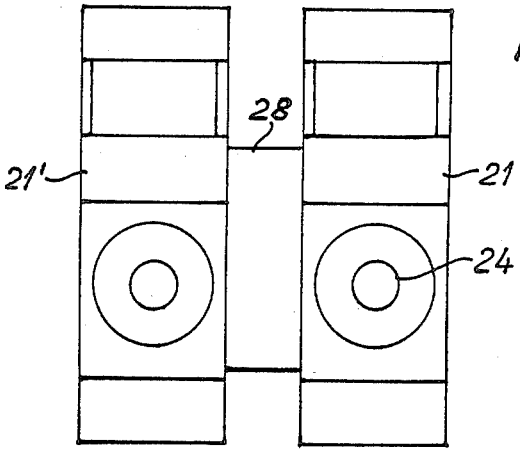
FIG. 7 is a side view of the conductor connector as seen from the right of FIG. 5.

In FIG. 6 it can be seen that a second housing 21' can be connected in parallel to housing 21, the second housing being similarly constructed and containing terminals 10 and 10' as described with reference to FIG. 5. The second housing is connected to housing 21 by a bridge element 28 having a bore 29 extending through the bridge. A fastening screw (not shown) may be extended through bore 29 for securing the two housings 21 and 21' to a suitable base.

Terminals 10 and 10' are simple to construct, are highly reliable, require little space and can be economically produced. They are especially suitable for connecting electric signalling wires and pilot wires, for example.

Another embodiment of the invention is illustrated in FIGS. 8 to 11 illustrating a threadless electric terminal 10'' in which similar elements will be designated by like reference numerals.

Figure 8:
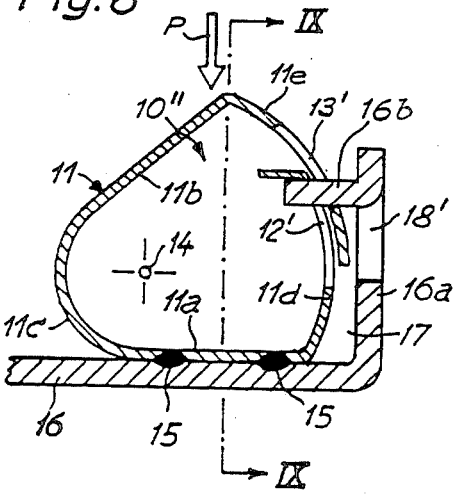
FIG. 8 is a fragmentary cross-sectional view taken substantially along the line VIII—VIII of FIG. 10 showing another embodiment of the terminal according to the invention.
Figure 9:
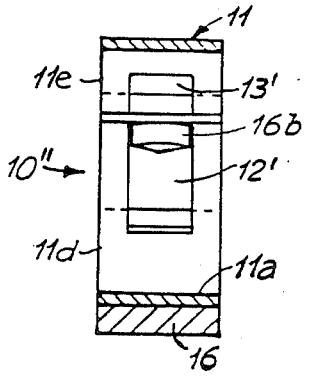
FIG. 9 is a cross-sectional view taken substantially along the line IX—IX of FIG. 8.
Figure 10:
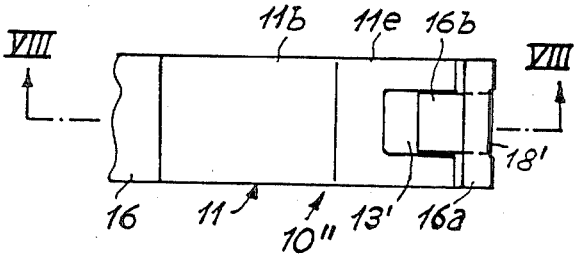
FIG. 10 is a plan view of FIG. 8.

Openings 12' and 13' provided in wing sections 11*d* and 11*e* may be rectangular. Flange 16*a* of contact element 16 may likewise have a rectangular shaped opening 18' which may be simply made by punching through an integral lug 16*b* from flange 16*a*. Rectangular 12' and 13' are sufficiently deep to permit lug 16*b* to extend through such openings which are partially aligned as shown in FIG. 8 in a condition of the plate spring shown in FIG. 8 in which the plate spring is under some tension. The lug extends through the upper portion of opening 12' so as to form an attachment surface for electric conductor 20 to be connected, as shown in FIG. 11.

Figure 11:
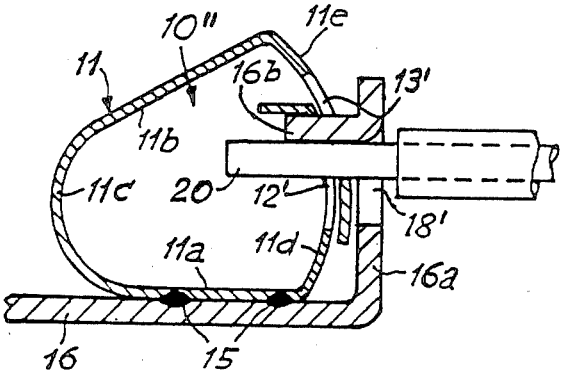
FIG. 11 is a view similar to FIG. 8 showing an elongated electric conductor connected to the terminal.

The operation of terminal 10'' of FIGS. 8 to 11 is similar to that of the FIGS. 1 to 4 embodiment. However, as shown in FIG. 11 the connected electric conductor 20 when clamped in place is resiliently urged against a larger contact surface of contact element 16 via lug 16*b*, as compared to that shown in FIG. 4, which thereby facilitates use of terminal 10'' for higher electric currents.

Also, opening 13' of the plate spring of terminal 10'' may be sufficiently shallow such that the lower edge of this opening resiliently bears against the underside of lug 16*b* so as to resiliently press the upper surface of the lug against the upper edge of opening 12' in the FIG. 8 condition during which no electric connector is clamped in place. Such arrangement facilitates a sufficiently high contact pressure to be applied when connecting thin conductors and litz wires of flat shape when clamping. Thus, the plate spring assures that opening 13' alone is adequate to maintain the connected conductor 20 from being pulled out of terminal 10''.

Also, a pair of terminals 10'' of the FIGS. 8 to 11 embodiment may be mounted in a common contact element 16 of the type shown in FIG. 5.

Obviously, many other modifications and variations of the present invention are made possible in the light of the above teachings. It is therefore to be understood that within the scope of the appended claims the invention may be practiced otherwise than as specifically described.

What is claimed is:

1. A threadless electric terminal, comprising an electric current conducting support and control element, at least one substantially V-shaped plate of spring material forming a V-spring, said plate having a pair of angularly spaced wing sections joined together to from a vertex at one end, a first of said wing sections being attached to said contact element, overlapping arms at opposite ends of said wing sections, said element having a flange lying parallel to said arm of said first wing section, said flange defining a space with said arm of said first wing section, said arms respectively having openings therein spaced from terminal ends of said respective arms such that an end portion of one of said arms at least partially blocks said opening in the other of said arms in an initial condition of said spring, said wing sections being resiliently movable relatively toward one another from said initial condition into a spring loaded condition in response to an external force applied to at least one of said wing sections for aligning said openings with one another for the reception of an elongated electric conductor, said arm of the second of said wing sections overlying said arm of said first wing section and being movable in said space in said spring loaded condition, said flange having an opening therein which at least partially aligns with said opening in said arm of said first wing section such that the conductor may extend through said openings when aligned in said spring loaded condition, said flange having a lug extending through said openings in said arms in said initial condition, and said wing sections being resiliently urged away from one another during said spring loaded condition upon release of said external force for clamping the conductor to said V-spring and to said lug as opposing edges of said openings resiliently engage the conductor.

* * * * *